US008207957B2

(12) United States Patent
Mizukoshi et al.

(10) Patent No.: US 8,207,957 B2
(45) Date of Patent: Jun. 26, 2012

(54) CURRENT CONTROLLED ELECTROLUMINESCENT DISPLAY DEVICE

(75) Inventors: Seiichi Mizukoshi, Kanagawa (JP); Nobuyuki Mori, Saitama (JP); Makoto Kohno, Kanagawa (JP); Kouichi Onomura, Yokohama (JP)

(73) Assignee: Global OLED Technology LLC, Wilmington, DE (US)

( * ) Notice: Subject to any disclaimer, the term of this patent is extended or adjusted under 35 U.S.C. 154(b) by 643 days.

(21) Appl. No.: 12/417,916

(22) Filed: Apr. 3, 2009

(65) Prior Publication Data

US 2009/0256783 A1 Oct. 15, 2009

(30) Foreign Application Priority Data

Apr. 15, 2008 (JP) ..... 2008-106024

(51) Int. Cl.
*G09G 5/00* (2006.01)

(52) U.S. Cl. ..... 345/211; 345/76

(58) Field of Classification Search ..... 345/76–83; 315/169.3

See application file for complete search history.

(56) References Cited

U.S. PATENT DOCUMENTS 5,719,589 A * 2/1998 Norman et al. ..... 345/82
6,542,142 B2 * 4/2003 Yumoto et al. ..... 345/90
6,731,276 B1 * 5/2004 Ishizuka ..... 345/211
6,734,636 B2 * 5/2004 Sanford et al. ..... 315/169.3
7,046,220 B2 * 5/2006 Tagawa et al. ..... 345/76
7,148,884 B2 * 12/2006 Kasai ..... 345/205
7,158,105 B2 * 1/2007 Miyazawa ..... 345/76
7,317,433 B2 * 1/2008 Chen et al. ..... 345/76
7,348,942 B2 * 3/2008 Jo ..... 345/76
7,880,690 B2 * 2/2011 Miyazawa ..... 345/76
8,044,895 B2 * 10/2011 Miyake et al. ..... 345/77
8,072,400 B2 * 12/2011 Mizukoshi et al. ..... 345/77
2003/0103022 A1 * 6/2003 Noguchi et al. ..... 345/77
2004/0056605 A1 * 3/2004 Yoshida ..... 315/169.3
2005/0052367 A1 * 3/2005 Miyazawa ..... 345/76
2006/0071887 A1 * 4/2006 Chou ..... 345/82
2007/0128583 A1 6/2007 Miyazawa
2008/0042947 A1 * 2/2008 Miyagawa et al. ..... 345/82
2008/0111812 A1 * 5/2008 Shirasaki et al. ..... 345/212

* cited by examiner

*Primary Examiner* — Ke Xiao
*Assistant Examiner* — Rodney Amadiz
(74) *Attorney, Agent, or Firm* — McKenna Long & Aldridge LLP

(57) ABSTRACT

An electroluminescent display device having a first and a second power supply; a respective power supply line for each row, wherein each power supply line is placed along a horizontal direction and is connected to the respective first electrodes of the driving TFTs of the pixels in the corresponding row; a plurality of switches, each connected to one or more power supply lines, for selectively connecting the corresponding one or more power supply lines to either the first or the second power supply; a gate driver for selecting a gate line; and a selecting circuit for controlling the plurality of switches, wherein the selecting circuit causes the power supply line corresponding to the selected gate line to be connected to the first power supply, and the one or more power supply lines not corresponding to the selected gate line to be connected to the second power supply.

4 Claims, 15 Drawing Sheets

CURRENT CONTROLLED ELECTROLUMINESCENT DISPLAY DEVICE

CROSS-REFERENCE TO RELATED APPLICATION

This application claims priority of Japanese Patent Application No. 2008-106024 filed Apr. 15, 2008 which is incorporated herein by reference in its entirety.

FIELD OF THE INVENTION

The present invention relates to an active matrix display device having a self-emissive element of a current-driven type in each of a plurality of pixels arranged in a matrix form and in which a display is achieved by controlling a current of the self-emissive element.

BACKGROUND OF THE INVENTION

FIG. 1 shows a basic structure of a circuit of a pixel (pixel circuit) in an active matrix organic electroluminescence (hereinafter referred to as "EL") display device, and FIG. 2 shows an example structure of a display device (display panel) and an input signal to the display device.

As shown in FIG. 1, the pixel circuit includes a selection thin film transistor (hereinafter referred to as "TFT") 2 having a source or a drain connected to a data line Data and a gate connected to a gate line Gate, a driving TFT 1 having a gate connected to the drain or the source of the selection TFT 2 and a source connected to a power supply PVdd, a storage capacitor C which connects between the gate and the source of the driving TFT 1, and an organic EL element 3 having an anode connected to the drain of the driving TFT 1 and a cathode connected to a low voltage power supply CV.

As shown in FIG. 2, a plurality of pixel sections 14 each having the pixel circuit shown in FIG. 1 are placed in a matrix form, to form a display section, and a source driver 10 and a gate driver 12 are provided for driving each pixel section in the display section.

An image data signal, a horizontal synchronization signal, a pixel clock, and other drive signals are supplied to the source driver 10, and the horizontal synchronization signal, a vertical synchronization signal, and other drive signals are supplied to the gate driver 12. The data line Data in the vertical direction extends from the source driver 10 for each column of the pixel sections 14 and the gate line Gate in the horizontal direction extends from the gate driver 12 for each row of the pixel sections 14.

The gate line (Gate) extending along the horizontal direction is set to a high level so that the selection TFT 2 is switched on, and a data signal having a voltage corresponding to a display brightness is supplied to the data line (Data) extending along the vertical direction in this state so that the data signal is accumulated in the storage capacitor C. With this process, a drive current corresponding to the data signal accumulated in the storage capacitor C is supplied by the driving TFT 1 to the organic EL element 3, and the organic EL element 3 emits light.

The current of the organic EL element 3 and the amount of light emission are in an approximate proportional relationship. Normally, a voltage (Vth) at which a drain current starts to flow around a black level of the image is supplied between the gate and PVDD (Vgs) of the driving TFT 1. As an amplitude of the image signal, an amplitude which results in a predetermined brightness around a white level is used.

FIG. 3 shows a relationship of a current CV current (which corresponds to the brightness) flowing through the organic EL element 3 with respect to the input signal voltage (voltage on the data line Data) of the driving TFT 1. By determining a data signal (Data voltage) so that Vb is supplied as the black level voltage and Vw is supplied as the white level voltage, the amount of light emission in the organic EL element 3 can be controlled from black to white, and a suitable grayscale control can be applied. As is clear from FIG. 3, the input voltage (Data voltage) of the pixel and the current are not in a completely proportional relationship.

In consideration of this, as shown in FIG. 4, a γ correction circuit (γ-LUT) 16 (16*r*, 16*g*, and 16*b*) is provided so that the relationship between the image data and the brightness is linear. The image data signal is a signal which represents brightness for each pixel, and because the image data signal is a color signal, the image data signal includes image data signals rn, gn, and bn for each color. Therefore, three γ correction circuits 16*r*, 16*g*, and 16*b* are provided corresponding to the colors of R, G, and B, and γ-corrected image data signals Rn, Gn, and Bn are output from the three γ correction circuits 16*r*, 16*g*, and 16*b*. Therefore, image data signals Rn, Gn, and Bn are supplied to the source driver 10, and subsequently, to the data line Data and to the pixel sections 14 for R display, for G display, and for B display, respectively. As shown in the figures, the source driver 10 includes a shift register 10*a* which temporarily stores the image data signal for each pixel, and a data latch and D/A 10*b* which latches image data signals of one horizontal line stored in the shift register 10*a*, simultaneously D/A converts the data of one horizontal line, and outputs the data. A region in which a plurality of the pixel sections 14 are arranged in a matrix form is shown in the figure as an effective pixel region 18 of the display panel, and a display is achieved in the effective pixel region 18 based on the image data signal.

Although the resistance component due to the electrical wiring is not shown in the pixel circuit of FIG. 1, because a plurality of pixels are connected to the PVDD line as shown in FIG. 2, if there is a resistance component, the voltage of the source of the transistor (TFT 1) which drives the organic EL element would vary depending on the magnitude of the current of the other pixels. In the example structure of FIG. 2, the PVDD line is placed for each column of pixels, and as the current to the pixels connected to the same PVDD line is increased, the voltage drop is also increased.

If the reduction in the source voltage of the driving TFT 1 occurs when the selection TFT 2 is switched ON and a data voltage is written to the storage capacitor C, because the data voltage written to the gate does not vary, the absolute value of Vgs of the driving TFT 1 is reduced, resulting in a reduction in the current in the driving TFT 1, a reduction in the current of the organic EL element 3, and a reduction in the light emission brightness. In order to solve this problem, in U.S. Patent Application Publication No. 2007/0128583, a transistor which switches the current of the pixel OFF during writing of data is added in order to prevent the voltage drop of the horizontal line.

FIG. 5 is a diagram showing a voltage drop when the whole of a panel on which a power supply line is provided along the horizontal direction in parallel to the pixels is switched ON. In this example configuration, vertical PVDD lines are provided on both sides of the display panel, and a power supply voltage PVDD is supplied from the outside through the PVDD terminal to the vertical PVDD line. When the voltage at a center of the pair of vertical PVDD lines is V1, a voltage at the center portion at the upper end and the lower end of the panel is V2, a voltage at the center portion of the panel is V3, a horizontal direction at the center in the vertical direction of the panel is x-x', and a vertical direction at the center of the horizontal direction of the panel is y-y', the voltage of the horizontal PVDD line is low at the center portion for x-x' and also for y-y'.

As described, when a current flows through a power supply line having a resistance component, a power supply voltage of the pixel circuit is reduced and the display brightness becomes uneven. For example, in a panel in which a power supply line is placed as shown in FIG. 5, when a white window pattern is displayed on a gray background, the left and right (portions b and c) of the window becomes darker than the other background portions (portions d and e) as the distance to the window is reduced, and a boundary with other portions becomes more noticeable, as shown in FIG. 6. In addition, if a transistor is added to the pixel circuit as a countermeasure as in Patent Document 1, the aperture ratio can be reduced or a percentage of failure can be increased, and thus a countermeasure is desired which does not require the addition of a transistor to the pixel circuit.

In accordance with the present invention, there is provided, in an electroluminescent display device having a plurality of pixels arranged in a plurality of rows and one or more columns and having for each row a respective gate line placed along a horizontal direction, wherein each pixel includes a selection thin film transistor (TFT) and a driving TFT each having respective first, second and gate electrodes, and an electroluminescence (EL) element, wherein the second electrode of the selection TFT is connected to the gate electrode of the driving TFT and the second electrode of the driving TFT is connected to the EL element, and wherein each gate line is connected to the respective gate electrodes of the selection TFTs of the pixels in the corresponding row, the improvement comprising:

(a) a first and a second power supply;

(b) a respective power supply line for each row, wherein each power supply line is placed along a horizontal direction and is connected to the respective first electrodes of the driving TFTs of the pixels in the corresponding row;

(c) a plurality of switches, each connected to one or more power supply lines, for selectively connecting the corresponding one or more power supply lines to either the first or the second power supply;

(d) a gate driver for selecting a gate line; and (e) a selecting circuit for controlling the plurality of switches, wherein the selecting circuit causes the power supply line corresponding to the selected gate line to be connected to the first power supply, and the one or more power supply lines not corresponding to the selected gate line to be connected to the second power supply.

According to one aspect of the present invention, there is provided an active matrix display device having a self-emissive element of a current-driven type in each of a plurality of pixels arranged in a matrix form and in which a display is achieved by controlling a current of the self-emissive element, the active matrix display device including a gate line which is placed along a horizontal direction and which switches a thin film transistor for supplying data to pixels of a corresponding horizontal line ON and OFF, a horizontal power supply line which is placed along a horizontal direction and which supplies a current to pixels of a corresponding horizontal line, and a switch wherein the horizontal power supply lines are divided into groups, each including one or a plurality of the horizontal power supply lines, and the switch connects, in a switching manner, the group of the horizontal power supply lines to at least two power supplies, wherein, with the switch, different power supplies are used for a power supply connected to the horizontal power supply line of a group to which a horizontal line selected by the gate line belongs and for a power supply connected to a horizontal power supply line of a group which does not include the horizontal line selected by the gate line.

According to another aspect of the present invention, it is preferable that, in the active matrix display device, the group includes a plurality of horizontal power supply lines, the active matrix display device includes a connecting section which is provided on one side or on both sides of the horizontal power supply line and which connects a plurality of horizontal power supply lines within a group, and the switch connects the connecting section to at least two power supplies in a switching manner.

According to another aspect of the present invention, it is preferable that, in the active matrix display device, the group includes one horizontal power supply line, and the switch connects each horizontal power supply line to at least two power supplies in a switching manner.

According to another aspect of the present invention, it is preferable that, in the active matrix display device, switching of the switch is controlled by the gate line.

According to another aspect of the present invention, it is preferable that, in the active matrix display device, as a power supply of a group to which a horizontal line selected by the gate line belongs, a voltage which is lower than a voltage of a power supply of other groups is used.

According to another aspect of the present invention, it is preferable that, in the active matrix display device, the self-emissive element of current-driven type is an organic electroluminescence element.

The present invention can inhibit a phenomenon in which a power supply voltage of a pixel circuit is reduced during writing of data, the data to be written varies, and the display brightness becomes uneven.

BRIEF DESCRIPTION OF THE DRAWINGS

Preferred embodiments of the present invention will be described in detail with reference to the drawings, wherein.

DETAILED DESCRIPTION OF THE INVENTION

A preferred embodiment of the present invention will now be described with reference to the drawings.

Figure 1:
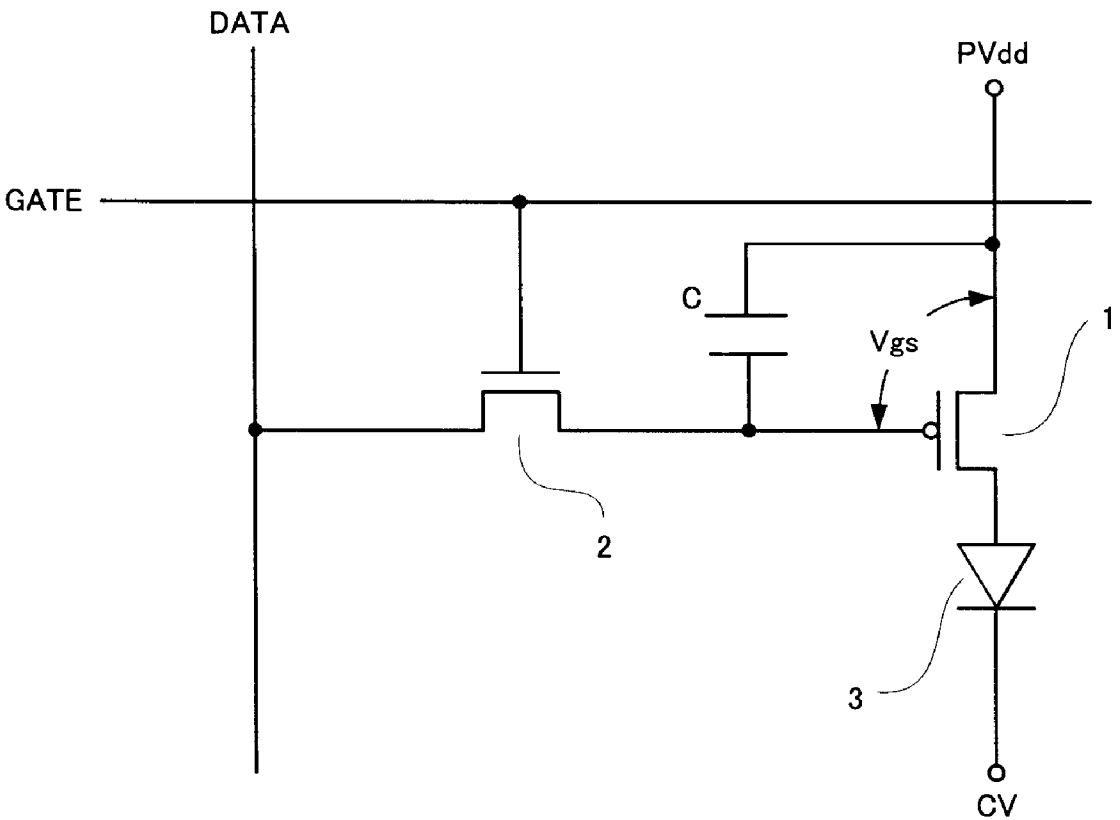
FIG. 1 RELATED ART
FIG. 1 is a diagram showing an example basic structure of a circuit of one pixel (pixel circuit) in an active matrix organic EL display device.
Figure 2:
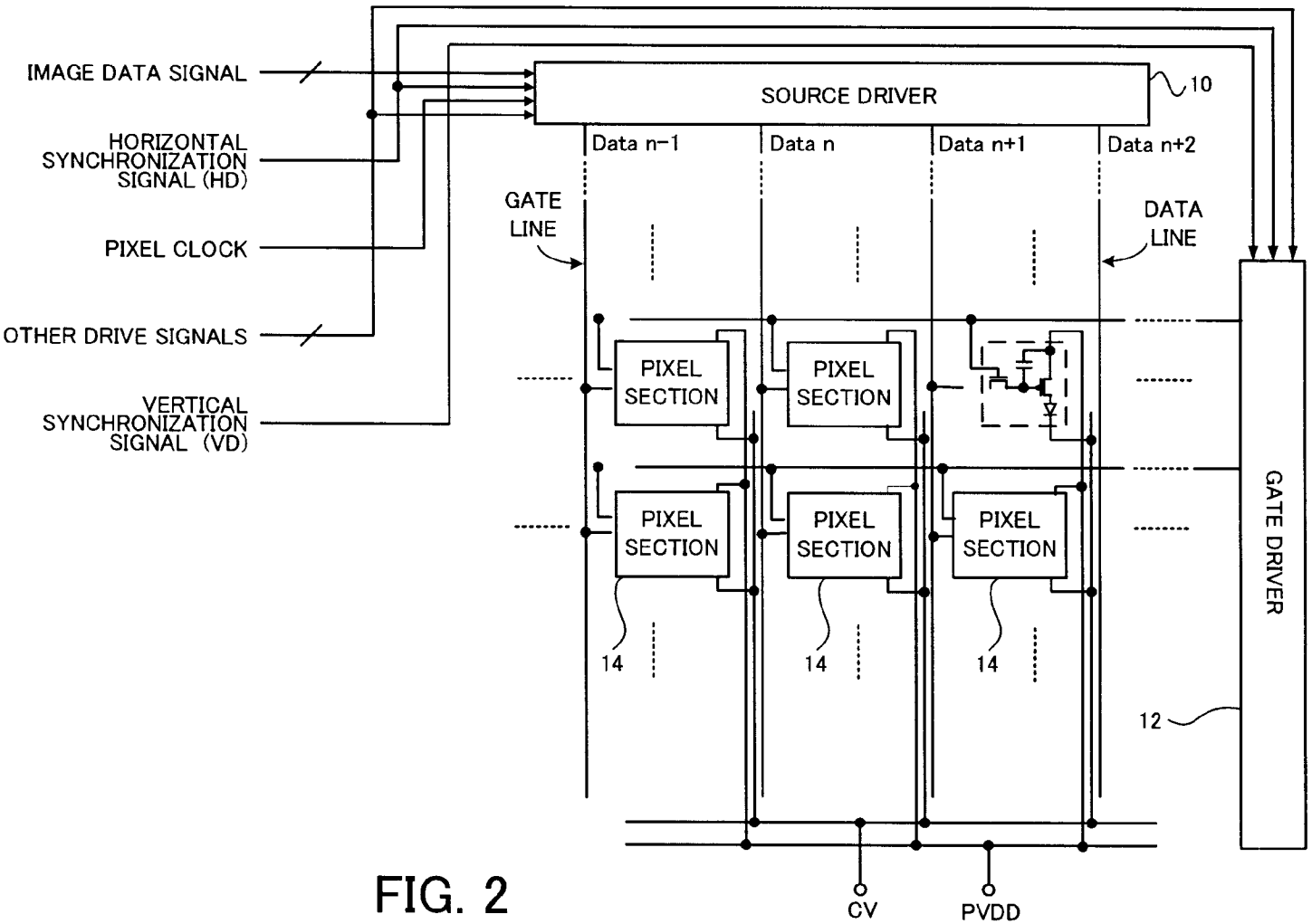
FIG. 2 RELATED ART
FIG. 2 is a diagram showing an example structure of a display module and an input signal.
Figure 3:
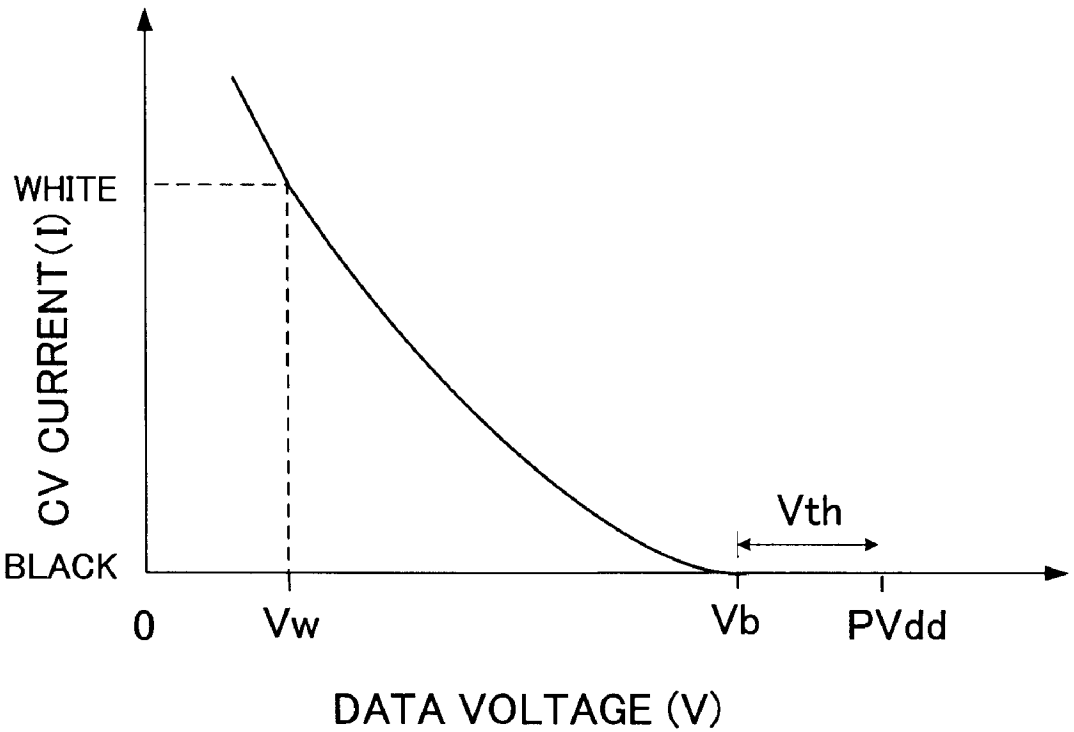
FIG. 3 RELATED ART
FIG. 3 is a diagram showing a relationship of a current CV current (which corresponds to the brightness) flowing through an organic EL element 3 with respect to an input signal voltage (voltage on data line Data) of a driving TFT 1.
Figure 4:
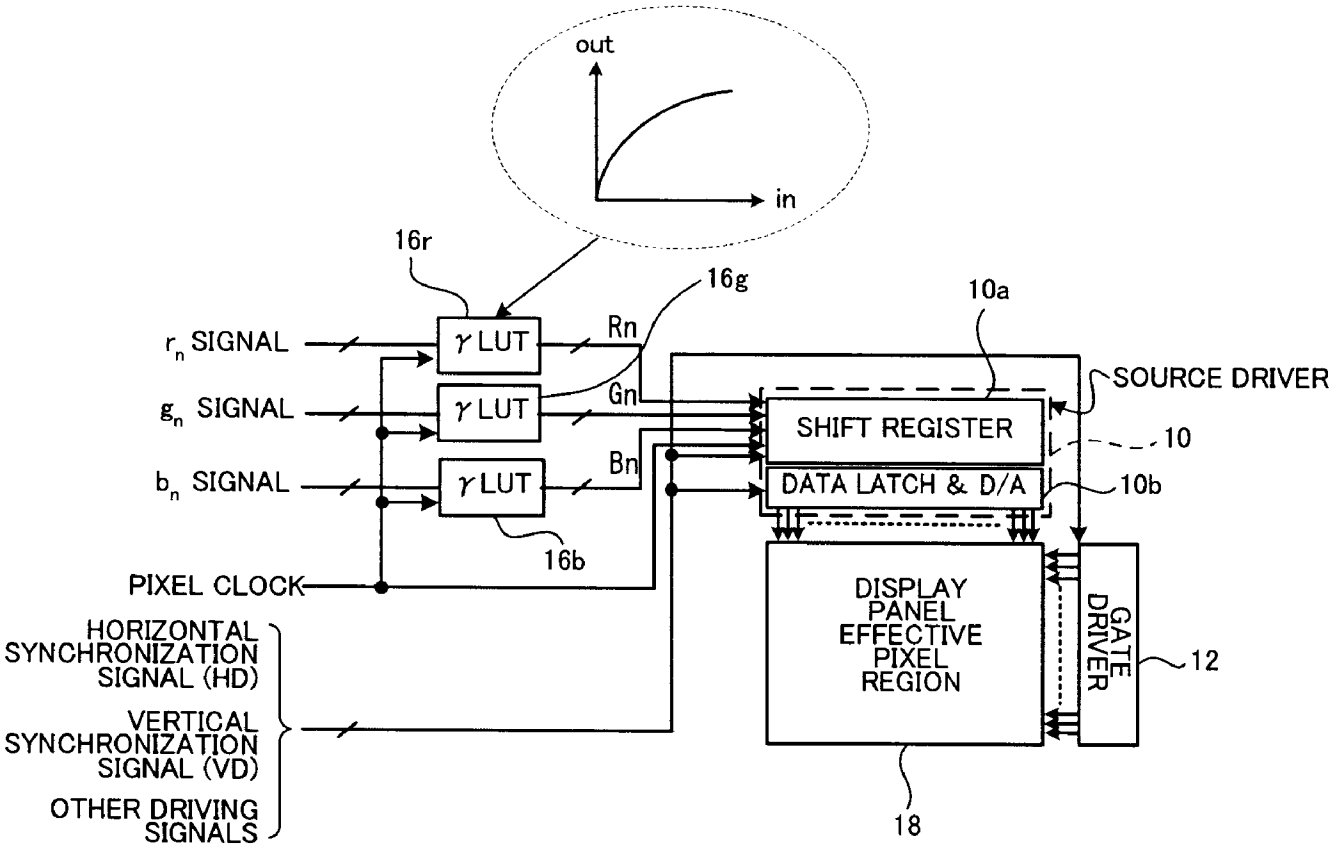
FIG. 4 RELATED ART
FIG. 4 is a diagram showing a structure of γ correction for realizing a linear relationship between an image signal and a pixel current.
Figure 5:
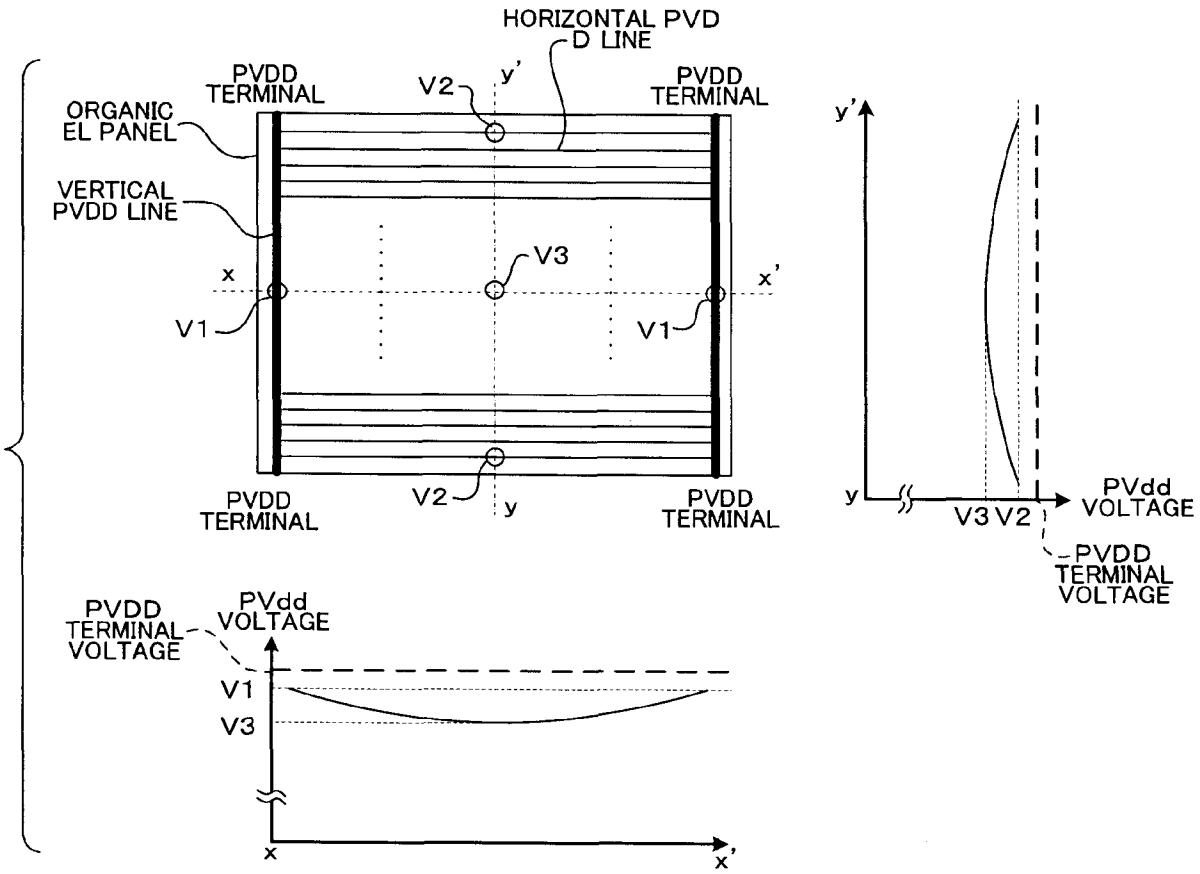
FIG. 5 RELATED ART
FIG. 5 is a diagram for explaining a change of a pixel power supply PVDD at a pixel position.
Figure 6:
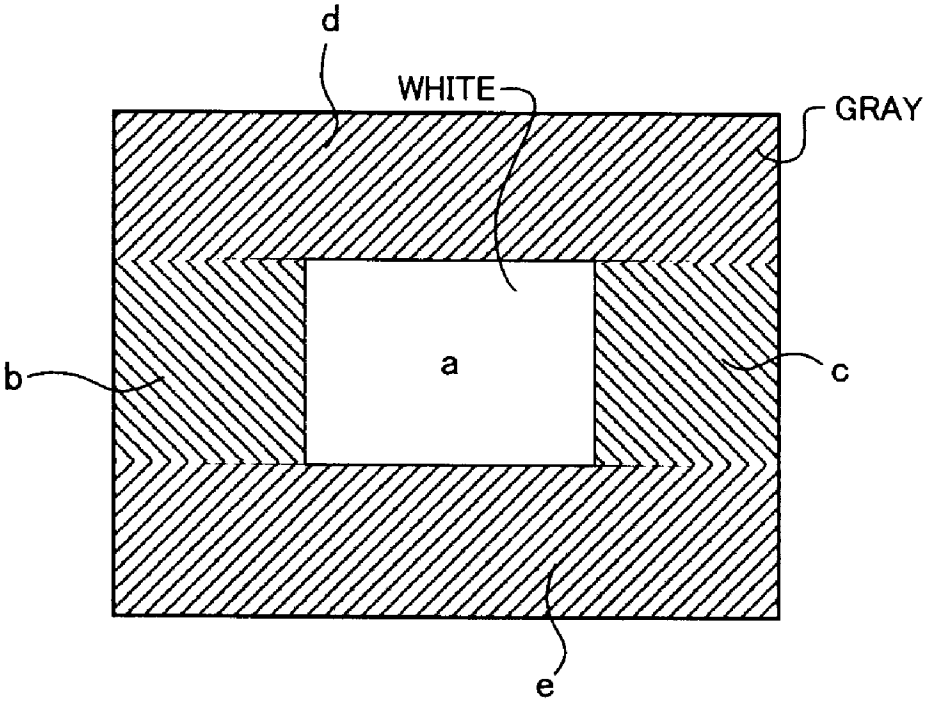
FIG. 6 RELATED ART
FIG. 6 is a diagram for explaining unevenness of brightness in the display.
Figure 7:
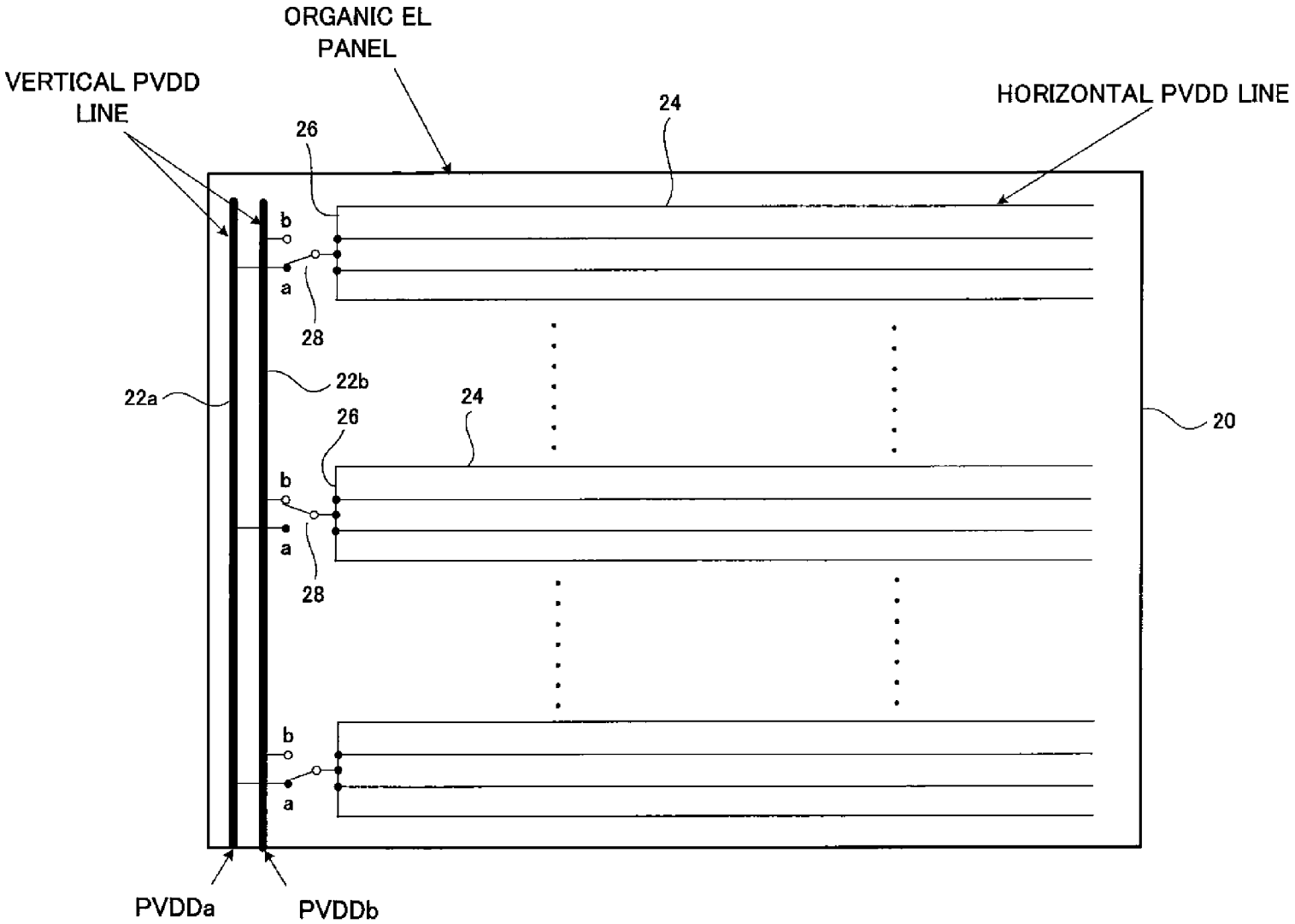
FIG. 7 is a diagram showing an example placement of vertical and horizontal PVDD lines (only on the left side of the vertical PVDD line)

FIG. 7 shows an example configuration in which a switch is provided on one side. In this example configuration, two vertical PVDD lines 22*a* and 22*b* are placed on the left side of an organic EL panel 20. As will be described later, power supply voltages PVDDa and PVDDb from different power supplies are supplied to these vertical PVDD lines 22*a* and 22*b*.

Horizontal PVDD lines 24 are grouped with four lines being one group, and left-side ends of the horizontal PVDD lines of one group are connected by a connecting line 26. The connecting section is connected to one of the two vertical PVDD lines 22*a* and 22*b* in a switching manner through the switch 28. In other words, in this example configuration, a switch 28 is provided for each group of four horizontal PVDD lines 24.

Figure 8:
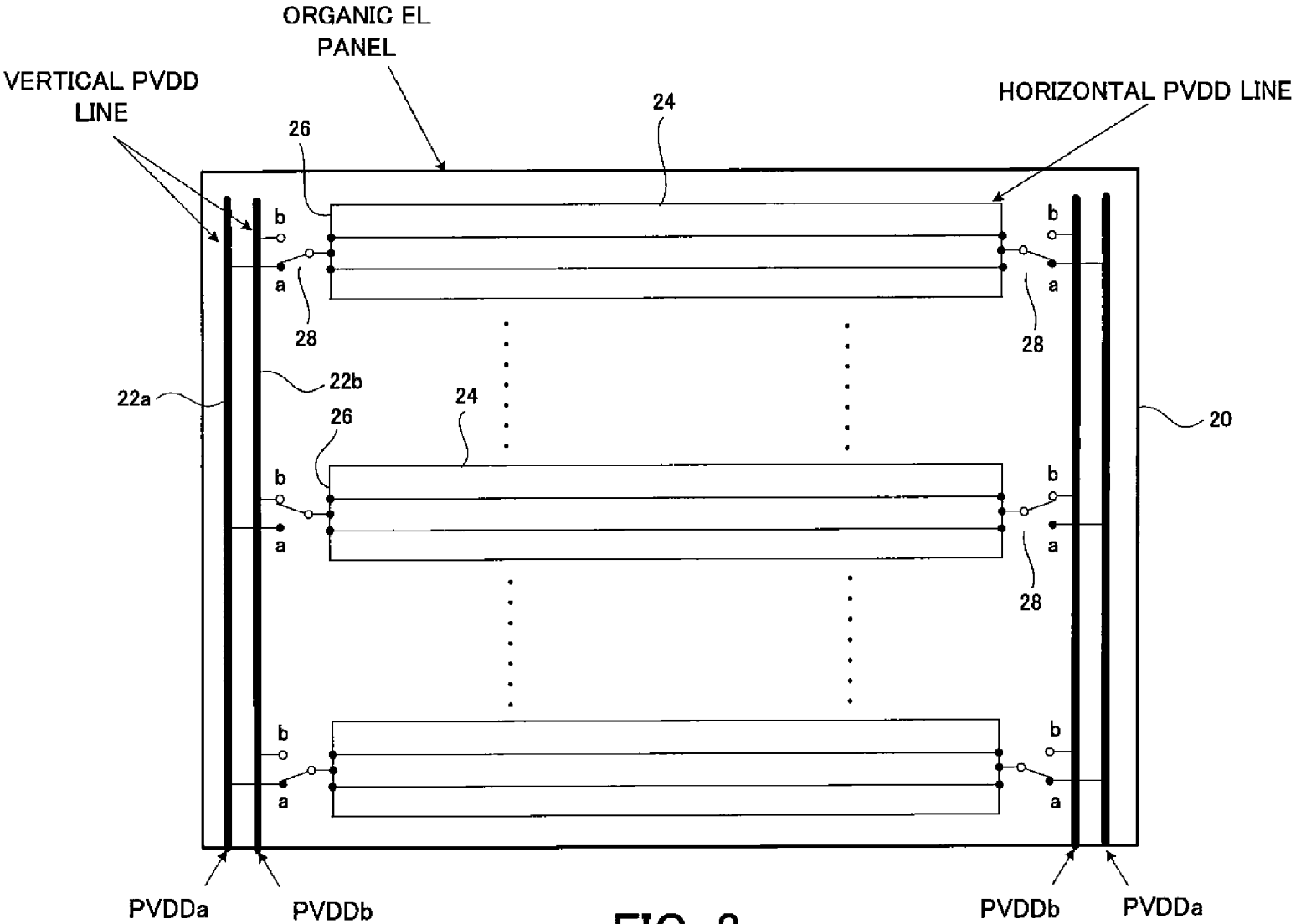
FIG. 8 is a diagram showing an example placement of vertical and horizontal PVDD lines (on both sides of the vertical PVDD line)

FIG. 8 shows an example configuration in which vertical PVDD lines 22*a* and 22*b* are provided on both sides of the organic EL panel 20 and the connecting line 26 and the switch 28 are also provided on both sides, so that electric power is supplied from both sides.

Figure 9:
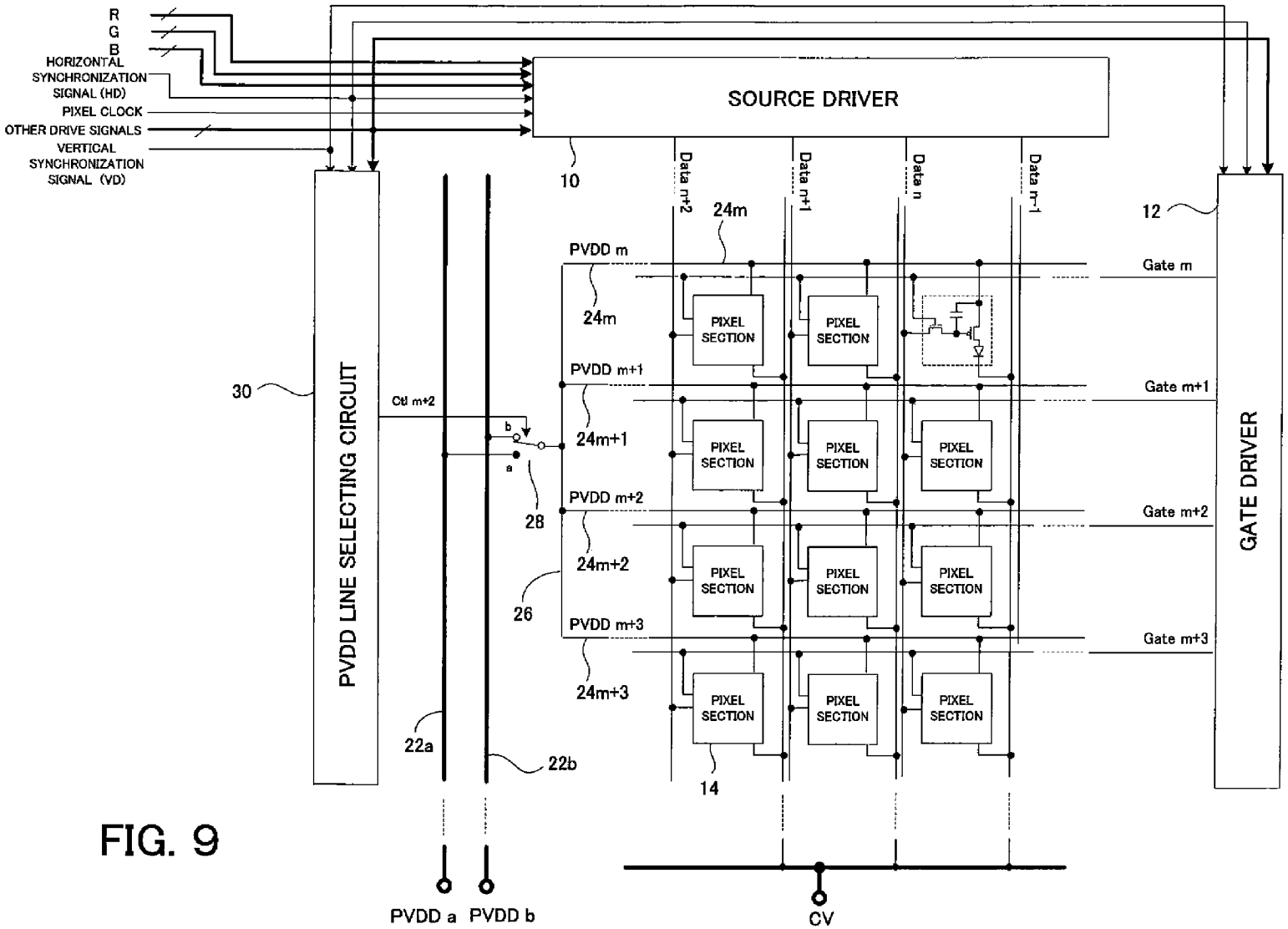
FIG. 9 is a diagram showing a structure for driving a switch 28 (an example structure in which four horizontal lines are grouped)

FIG. 9 shows pixels of three columns among four horizontal lines when a switch 28 is provided for each group of four horizontal PVDD lines 24. Normally, the switch 28 is switched toward the side a, so that the power supply is supplied from PVDDa to the mth horizontal PVDD line 24*m*.

When, on the other hand, a gate line of a horizontal line should be set to the high level in order to write data to the pixel on the horizontal line in the group, the switch 28 is controlled simultaneously with setting of the high level such that PVDDb is supplied from the vertical PVDD line 22*b*, and the switch is switched to the side b. The control of the switch 28 is executed by a PVDD line selecting circuit 30 based on a horizontal synchronization signal (HD) or the like. Basically, when the gate driver 12 selects gate lines Gatem–Gatem+3, switches 28 corresponding to these gate lines are selected.

Normally, the image data is written for each line from the upper part of the screen. In other words, the gate line Gate is set to the high level line by line, and pixel data supplied to the corresponding data line Data is read in the corresponding pixel section 14. Because of this, the gate lines Gatem to Gatem+3 are set to the high level in order, and the switch is switched to the side b during this process. In this process, because the current flowing from the power supply PVDDb through the vertical PVDD line 22*b* is a total of currents of the pixels of the four lines, the current is "4/(total number of horizontal lines)" of the pixel current of one screen. Therefore, it is easy to design the vertical PVDD line 22*b* so that the resistance is set to an extent that the voltage drop from the power supply terminal (PVDDb terminal) to the switch can be ignored. If the voltage drop due to the resistance of the horizontal PVDD line 24 can be ignored, an accurate data voltage can be written to the pixel.

On the other hand, pixels of all other lines are connected to the vertical PVDD line 22*a*. Because of this, a large current flows through the vertical PVDD line 22*a* and the current changes according to the content of the image. Therefore, when there is a resistance component, the voltage on a connection point a of the switch 28 changes.

When the writing to the pixels of the group of mth–(m+3)th horizontal lines is completed, the switch 28 is switched and is connected to the vertical PVDD line 22*a*. Because the voltage between terminals of the storage capacitor, that is, Vgs, does not change even when the PVdd voltage of the pixel changes, light can be emitted at the same brightness until the next writing process if an accurate Data voltage is written to the storage capacitor C.

Figure 10:
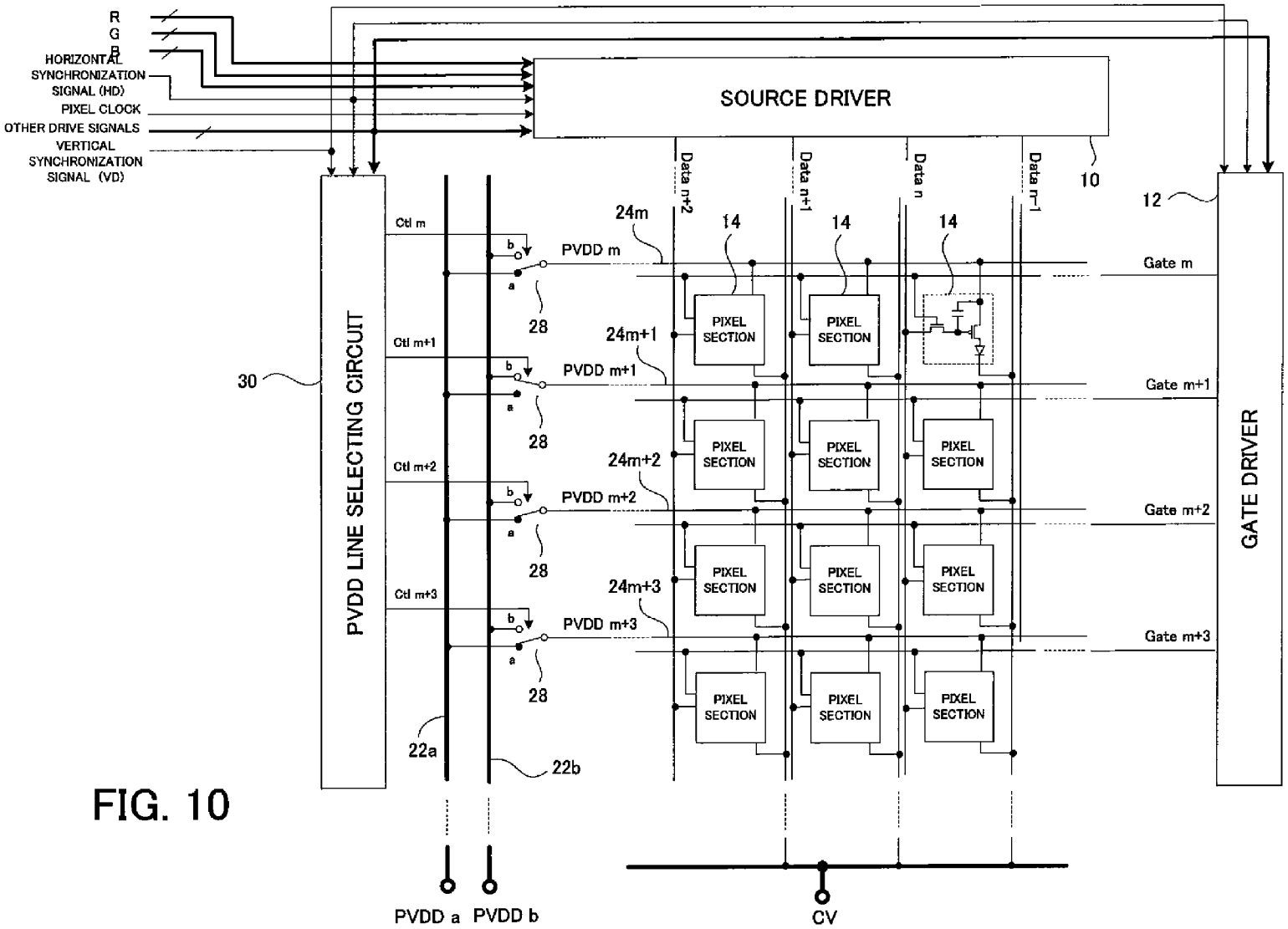
FIG. 10 is a diagram showing a structure for driving a switch 28 (an example structure for each horizontal line)
Figure 11:
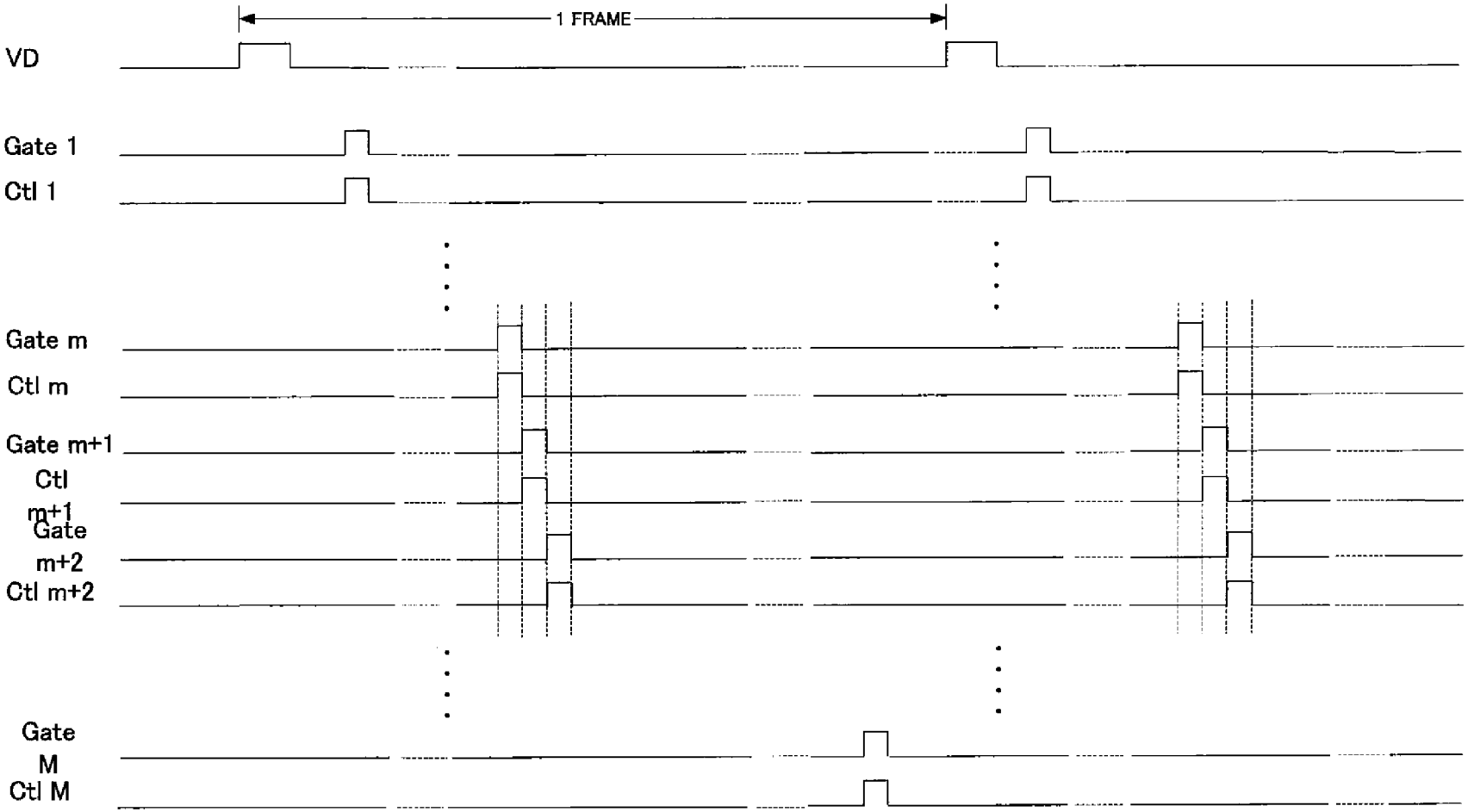
FIG. 11 is a timing chart of the driving of FIG. 10.

FIG. 10 shows an example configuration in which a switch 28 for switching the power supply is provided for each horizontal line. FIG. 11 shows timing for control of the switches when the panel has M horizontal lines.

In the example configuration of FIG. 10, the switch 28 is provided for each horizontal line, and is controlled by a PVDD line selecting circuit 30. In FIG. 10, mth–(m+3)th lines are shown. The switch 28 of the line selected by the gate line Gate is switched to the side b, and the current is supplied from the power supply PVDDb only for this line. In the configuration of FIG. 10, the (m+1)th line is selected. The switches 28 of the other, non-selected lines, on the other hand, are switched to the side a, and thus it the voltage drop when data is written to the pixel can be inhibited and minimized.

Figure 12:
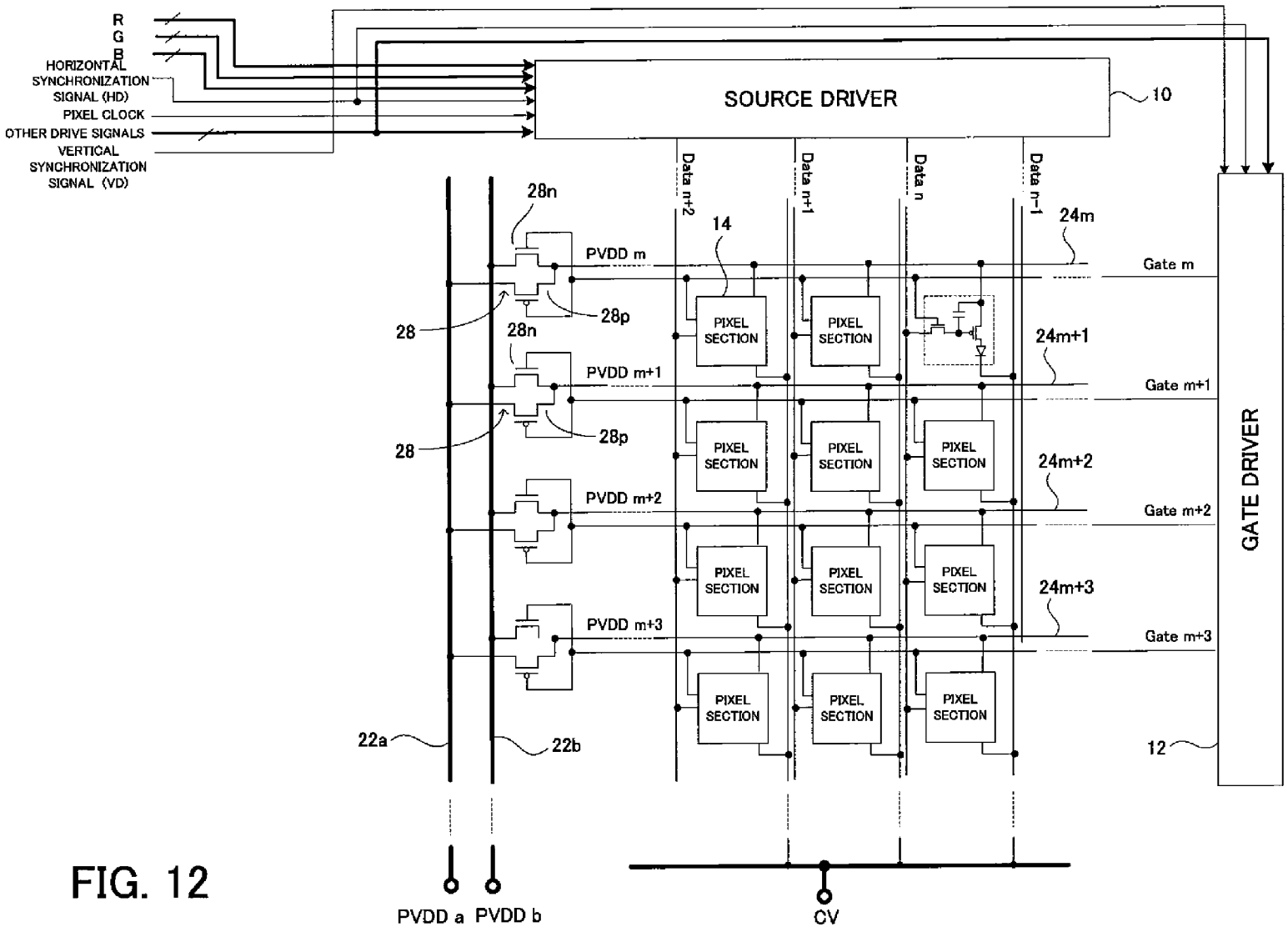
FIG. 12 is a diagram showing an example configuration in which a TFT is used for the switch 28.

FIG. 12 shows an example configuration in which the switch 28 is formed with a TFT. As is clear from FIG. 11, the timing when the control signal of the switch 28 is set to the high level is identical to the timing when the gate line Gate is set to the high level. Thus, in the example configuration of FIG. 12, the switch 28 is controlled by the signal of the gate line Gate.

A p-type TFT connects the vertical PVDD line 22*a* to the horizontal PVDD line 24 and an n-type TFT connects the vertical PVDD line 22*b* to the horizontal PVDD line 24. In addition, corresponding gate lines are connected to the gates of the TFTs 28*p* and 28*n*. Therefore, when the gate line is at the high level (selected), the TFT 28*n* is switched ON and the vertical PVDD line 22*b* is connected to the horizontal PVDD line 24, and when the gate line is at the low level (non-selected), the TFT 28*p* is switched ON, and the vertical PVDD line 22*a* is connected to the horizontal PVDD line 24.

Normally, because the horizontal power supply line has a relatively high resistance, the power supply voltage supplied to each pixel (PVdd voltage) is reduced by the pixel current for one horizontal line. As described above, when there is a voltage drop in PVdd when pixel data is written, a voltage which is lower than a desired voltage is written between the terminals of the storage capacitor C between the gate and the source of the TFT 1, and the current flowing through the organic EL element 3 is reduced. Therefore, it is desirable to reduce the pixel current on the horizontal line when the data voltage is written.

Figure 13B:
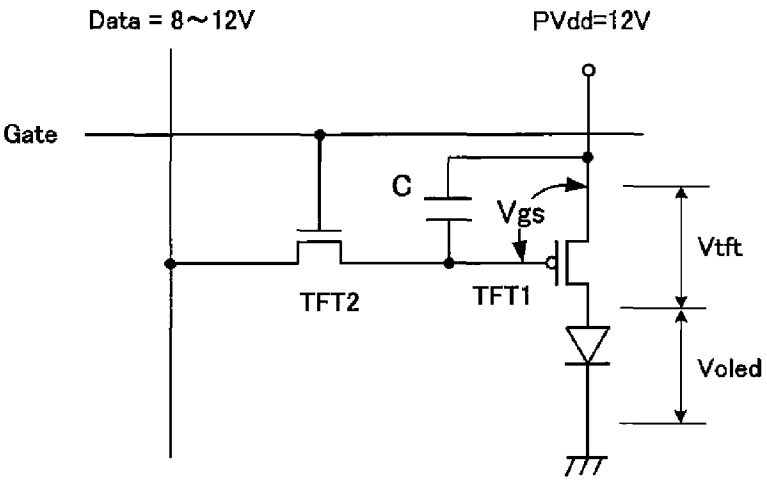
FIG. 13B is a diagram showing a power supply voltage and a data voltage of a pixel circuit.
Figure 13A:
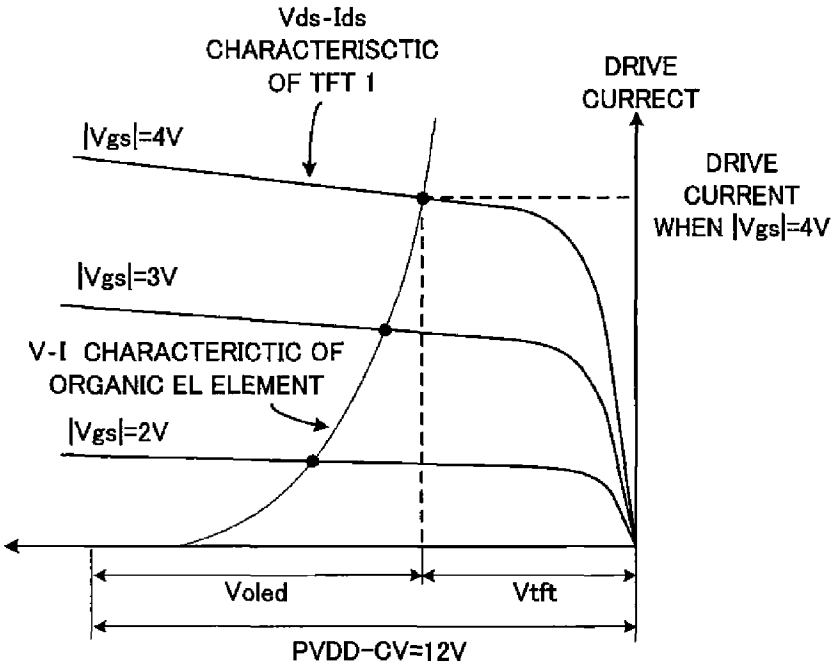
FIG. 13A is a diagram showing a relationship between a power supply voltage and a drive current.
Figure 15:
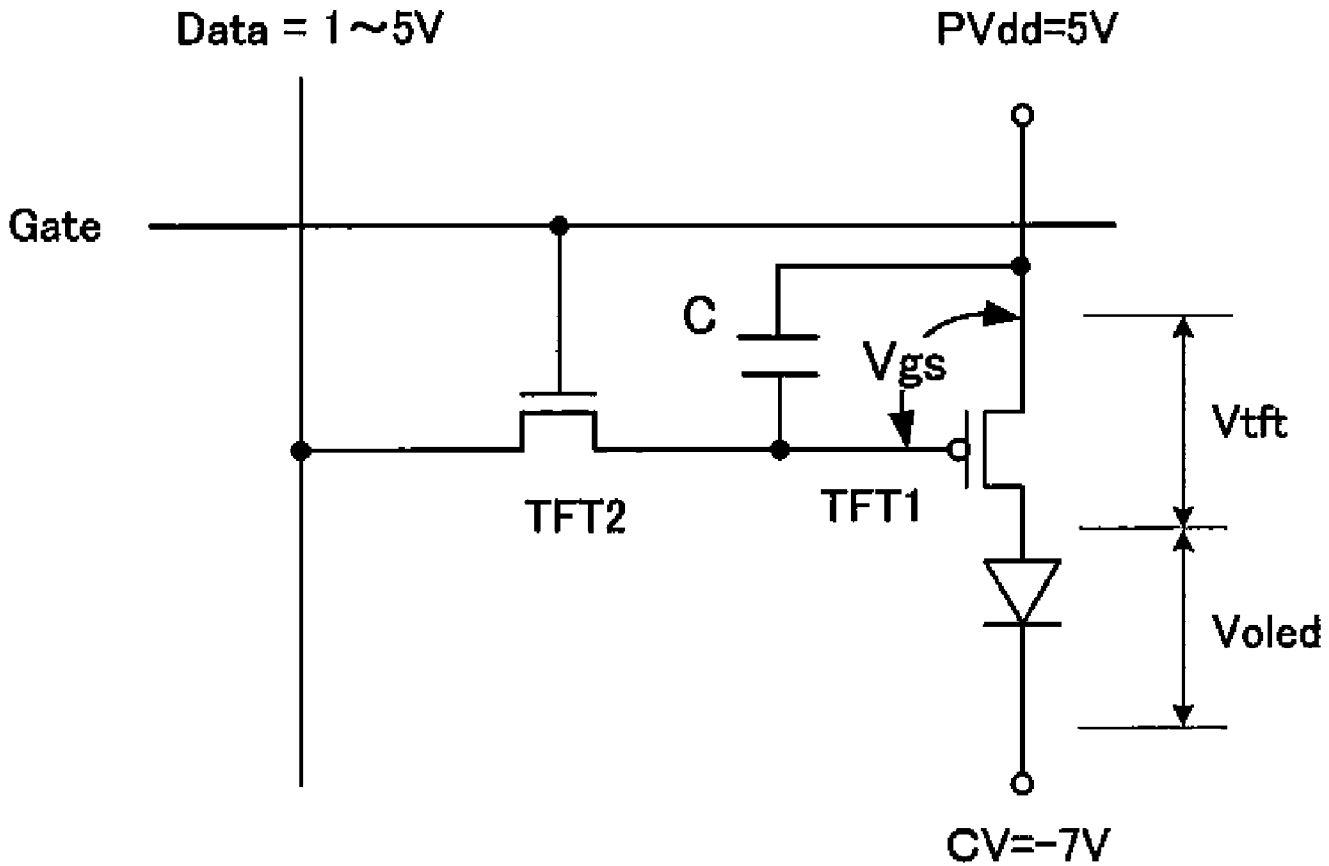
FIG. 15 is a diagram showing a power supply voltage and a data voltage of a pixel circuit.

Normally, the voltage between PVdd and CV (PVdd-CV) is determined by factors such as the characteristics of the driving TFT 1 and the organic EL element 3 and a maximum amplitude value of the input data voltage (Vp-p). FIG. 13A shows an operation point of a pixel circuit when (PVdd-CV) is 12 V. A current at a cross point of a drain-source voltage-drain-source current characteristic (Vds-Ids characteristic) when a certain Vgs is applied to the TFT 1 and the V-I characteristic of the organic EL element flows through the organic EL element. In this example configuration, a maximum current corresponding to the white level flows when Vgs=4 V. FIG. 13B shows an example method of supplying the power supply PVdd (12 V) and the Data voltage in this case. As shown in FIG. 13B, a high voltage (8 V-12 V) is required for the data voltage, and a high voltage is required for the output voltage of the source driver. In order to avoid this, normally, as shown in FIG. 15, a negative power supply (in this example configuration, −7 V) is used for CV. In this case, because 1 V-5 V is required as the Data voltage, the source driver IC can be driven with a low voltage.

When the voltage between PVDD and CV is reduced, the pixel driving TFT is deviated from the saturation region and the pixel current is reduced. FIG. 14A shows an operation point when (PVdd-CV) is set to 5 V. In this manner, by setting the PVDD power supply voltage at the time of writing, that is, the voltage of PVDDb, to be sufficiently lower than the voltage PVDDa at the normal time, the pixel current can be reduced and voltage drop of PVdd during writing inhibited. In other words, even when data of 4 V is written as Vgs, the current which flows when the data is written is very small. In addition, because Vgs=4 V can be written by supplying 1 V as the data voltage and Vgs=0 can be written with a data voltage of 5 V, only a range of 1 V-5 V is required as the data voltage, and the voltage of the source driver can be reduced.

Figure 14B:
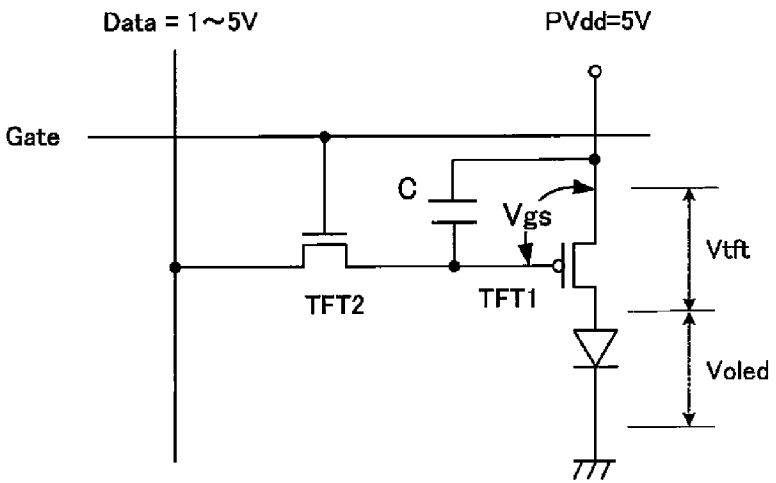
FIG. 14B is a diagram showing a power supply voltage and a data voltage of a pixel circuit.
Figure 14A:
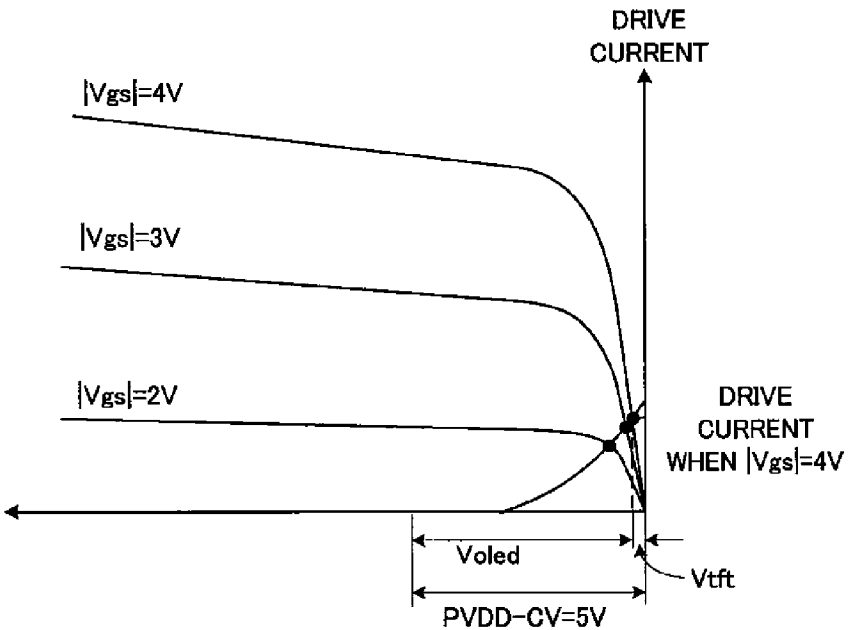
FIG. 14A is a diagram showing a relationship between a power supply voltage and a drive current.

Therefore, as shown in FIG. 14B, the voltage of the source driver can be reduced without the use of the negative power supply for CV. In particular, when the source driver is formed as an IC, the power supply voltage of the source driver IC can be reduced. When the data is written, the brightness of the pixels of the group to which the line belongs (four lines in the example configuration of FIG. 9). However, when the writing is completed and the voltage is returned to the normal PVdd voltage, the brightness becomes the predetermined brightness, and thus the number of lines in the group can be sufficiently small compared to the total number of horizontal lines so that the reduced brightness is visually unnoticeable. From this viewpoint, the number of lines in a group is preferably small. However, when the number of lines in a group is small, the number of switches is increased.

The PVDD line control circuit and the switching circuit of PVDD do not need be formed using TFTs, and alternatively an IC chip having the corresponding function can be used.

The invention has been described in detail with particular reference to certain preferred embodiments thereof, but it will be understood that variations and modifications can be effected within the spirit and scope of the invention.

Parts List

1 driving TFT
2 selection TFT
3 organic EL element
10 source driver
10*a* shift register
10*b* data latch
12 gate driver
14 pixel sections
16 γ correction circuit
16*r* γ correction circuit
16*g* γ correction circuit
16*b* γ correction circuit
18 pixel region
20 organic EL panel
22*a* vertical PVDD line
22*b* vertical PVDD line
24 horizontal PVDD lines
26 connecting line
28 switch
28*n* TFT
28*p* TFT
30 selecting circuit

The invention claimed is:

1. An electroluminescent display device having a plurality of pixels arranged in a plurality of rows and one or more columns and having for each row a respective gate line placed along a horizontal direction, wherein each pixel includes a selection thin film transistor (TFT) and a driving TFT each having respective first, second and gate electrodes, and an electroluminescence (EL) element, wherein the second electrode of the selection TFT is connected to the gate electrode of the driving TFT and the second electrode of the driving TFT is connected to the EL element, and wherein each gate line is connected to the respective gate electrodes of the selection TFTs of the pixels in the corresponding row, the improvement comprising:

(a) a first and a second power supply;

(b) a respective power supply line for each row, wherein each power supply line is placed along a horizontal direction and is connected to the respective first electrodes of the driving TFTs of the pixels in the corresponding row;

(c) a plurality of switches, each connected to one or more power supply lines, for selectively connecting the corresponding one or more power supply lines to either the first or the second power supply;

(d) a gate driver for selecting a gate line; and (e) a selecting circuit for controlling the plurality of switches, wherein the selecting circuit causes the power supply line corresponding to the selected gate line to be connected to the first power supply, and the one or more power supply lines not corresponding to the selected gate line to be connected to the second power supply, wherein the first power supply has a lower voltage than the second power supply.

2. The electroluminescent display device according to claim 1, wherein each switch corresponds to a single row, and each switch is connected to exactly one power supply line of the corresponding row.

3. The electroluminescent display device according to claim 2, wherein the selecting circuit includes, for each row, a connection between the corresponding gate line and the corresponding switch, so that the switching of the switch is controlled by the gate line.

4. The electroluminescent display device according to claim 1, wherein each EL element is an organic electroluminescence element.

* * * * *